US007633363B2

(12) United States Patent
Fausch

(10) Patent No.: US 7,633,363 B2
(45) Date of Patent: Dec. 15, 2009

(54) RELAY

(75) Inventor: Werner Fausch, Buchs (CH)

(73) Assignee: Elesta Relays GmbH, Bad Ragas (CH)

( * ) Notice: Subject to any disclaimer, the term of this patent is extended or adjusted under 35 U.S.C. 154(b) by 94 days.

(21) Appl. No.: 11/723,075

(22) Filed: Mar. 16, 2007

(65) Prior Publication Data

US 2007/0216502 A1 Sep. 20, 2007

(30) Foreign Application Priority Data

Mar. 20, 2006 (CH) ..... 00426/06

(51) Int. Cl.
*H01H 67/02* (2006.01)

(52) U.S. Cl. ..... 335/129; 335/78; 335/79; 335/80; 335/81; 335/82; 335/83; 335/84; 335/85; 335/86; 335/124; 335/128; 335/130; 335/131; 335/202

(58) Field of Classification Search ..... 335/78–86, 335/124, 128, 129, 130, 131, 202
See application file for complete search history.

(56) References Cited

U.S. PATENT DOCUMENTS 4,405,911 A * 9/1983 Hasegawa et al. ..... 335/202
5,053,756 A * 10/1991 Wehrle et al. ..... 335/128
5,111,171 A * 5/1992 von Bonin et al. ..... 335/202
5,568,108 A * 10/1996 Kirsch ..... 335/130
5,831,502 A * 11/1998 Kirsch ..... 335/129
6,034,582 A * 3/2000 Fausch ..... 335/78
6,081,177 A * 6/2000 Fausch ..... 335/129

(Continued)

FOREIGN PATENT DOCUMENTS

EP 1 143 474 A 10/2001

(Continued)

OTHER PUBLICATIONS

European Search Report issued Jun. 22, 2007 in European Patent Application No. 07 40 5020.

*Primary Examiner*—Elvin G Enad
*Assistant Examiner*—Mohamad A Musleh
(74) *Attorney, Agent, or Firm*—Buchanan Ingersoll & Rooney PC

(57) ABSTRACT

A forcibly guided relay is disclosed, with a housing, whose height is smaller than its width and whose width is smaller than its length. With this, the relay comprises an electromagnetic drive filling the length or the width of the relay, with a clapper-type contactor which comprises a drive arm which extends in the direction of the core and at its free end cooperates with a drive cam; several contact pairs, which are in each case formed by a contact spring and a fixed or spring-like counter-contact said contact springs extending in the direction of the core, and with the drive ends being in a forcibly guided engagement with the drive cam. With this relay a break contact is arranged directly next to the contactor, whose contact spring in each position of the contactor runs approximately parallel to the drive arm of the clapper-type contactor; and a separating wall is present between the clapper-type contactor and the break-contact, at least in the region between the contact heads of the break-contact, and the drive cam, runs approximately parallel to the drive arm of the clapper-type contactor in the activated position spread away from the coil.

21 Claims, 5 Drawing Sheets

U.S. PATENT DOCUMENTS

| | | | | |
|---|---|---|---|---|
| 6,559,744 | B1 * | 5/2003 | Kirsch | 335/78 |
| 6,906,604 | B1 * | 6/2005 | Mader et al. | 335/129 |
| 2001/0045878 | A1 * | 11/2001 | Fausch | 335/129 |
| 2002/0050885 | A1 * | 5/2002 | Gruner | 335/129 |
| 2003/0085784 | A1 * | 5/2003 | Weber | 335/129 |
| 2005/0200439 | A1 * | 9/2005 | Kawahara et al. | 335/128 |

FOREIGN PATENT DOCUMENTS

| | | | |
|---|---|---|---|
| EP | 1 308 976 | A | 5/2003 |
| FR | 2 423 855 | A1 | 11/1979 |

* cited by examiner

RELAY

FIELD OF THE INVENTION

The invention relates to a forcibly guided relay with an electromagnetic drive.

SUMMARY

Forcibly guided relays are known in a multitude of embodiments. As a result of the constant development in the direction of miniaturisation of circuits, the developers of relays are under some pressure to provide relays with as small as possible dimensions. For the installation into a 17.5 mm standard housing of safety circuits for apparatus controls, e.g. the height of the relay may be 12 mm at the most. Furthermore, as the case may be, SMD-components should be able to be accommodated between the relay and the printed circuit board, onto which the relay is stuck. This miniaturisation causes the tolerance ranges in the inside of the relay to be reduced. This, amongst other things, leads to the fact that the distances between current-conducting parts in the inside of the relay are reduced, and therefore the creepage distances and sparking distances between these parts must be extended by way of intermediate constructions, that the dimensions of contact springs and the flash strengths of contact heads are reduced, and that the adjustment of the contact springs becomes more of a problem. Indeed, not only are the tolerances for the circuit paths low, but also the force conditions between the contact springs and the drive do not leave much of a tolerance margin.

It is therefore the object of the invention to suggest a relay, which has very small dimensions.

According to the invention, this object is achieved by the subject matter of claim 1.

A further object of the invention is to prepare a basis for being able to provide a relay series, said relays being equipped with 3, 4, 6 and, as the case may be, 8 contact pairs, which may be loaded in each case with at least 6, preferably 8 or even 10 Amps, whose heights project maximally by 12 mm beyond the connection pins, which are maximally 35 mm wide and 56 mm long, and which fulfil the Euro standard EN 50205 for forcibly guided relays. As many components as possible, in particular the contact pairs, are to be designed identically with the relays of this series. A further object is for the relays to be adjusted in a manner which is as simple as possible.

A forcibly guided relay according to the invention has a housing determining the outer dimensions, whose height is smaller than its width, and whose width is smaller than its length.

The relay comprises an electromagnetic drive filling the length or width of the relay, with a clapper-type contactor, which comprises a drive arm extending in the direction of the core. The drive arm at its free end cooperates with a drive cam. The relay furthermore comprises several contact pairs which are formed in each case by a contact spring and a fixed or spring-like counter-contact. The contact springs extend in the direction of the core, and with their drive ends are in forcibly guided engagement with the drive cam.

With this relay, the contact pair which is arranged directly next to the contactor, is a break-contact, whose contact spring in each position of the contactor, runs at least approximately parallel to the drive arm of the clapper-type contactor. In the activated position of the drive arm of the clapper-type contactor, which is spread away from the coil, a separating wall present between the clapper-type contactor and the break-contact, runs approximately parallel to the drive arm, at least in the region between the contact head of the break-contact and the drive cam.

The drive usefully comprises a coil with an elongate core of magnetic soft iron, and a winding present around the core. The winding has a diameter which practically fills the height of the housing.

The contact springs usefully comprise a foot and a free drive end, as well as a contact head between the foot and the drive end. They are each anchored in the housing with the foot at locations along a side of the housing lying perpendicular to the direction of the core, said locations being distanced to one another. They extend in the direction of the core and with their drive ends are in forcibly guided engagement with the drive cam.

The contact pins for the contact pairs and for the drive, project out of the housing perpendicular to a surface of the housing defined by width and length.

Such a forcibly guided relay in one embodiment comprises an electromagnetic drive filling the length of the relay, and six contact pairs, as well as the necessary contact pins for the six contact pairs and for the drive. The six contact pairs are in each case formed by a contact spring and a fixed counter-contact. The contact springs with the foot are anchored in the housing along the width of the housing at locations which are distanced to one another. The drive ends of the contact springs of three contact pairs arranged in a row are directed counter to the drive ends of the contact springs of three contact pairs arranged in a second row.

Other embodiments comprise an electromagnetic drive filling the width of the relay, and three or four contact pairs, as well as the necessary contact pins for the contact pairs and for the drive. With these embodiment examples, the contact pairs are only arranged in one row.

With such a relay, one may not only achieve very small dimensions, but also EN 50205 and a current-carrying capacity of 6 to 10 A, in particular one of 8 A, per contact pair. The height of the relay advantageously measures maximal 12 mm, preferably maximally 11 mm. The embodiment examples described in more detail by way of the Figures measure 10.5 mm. The diameter of the coil measures 8 to 10 mm, preferably 8.5 to 9.5 mm. The coil diameter with the embodiment examples measures approx. 9 mm.

The length of the two-row relay usefully measures maximally 56 mm, preferably maximally 54.5 mm, and the length of the coil at least 40 and at the most 46 mm, preferably at least 42, and at the most 44 mm. With the two-rowed embodiment example, the housing length measures 53.8 and the coil length 42.7 mm.

The coil is practically half as long with the relays with only one row of contact pairs. The outer dimensions in the direction of the coil, and the core and the coil length are 24.2 mm smaller than with a relay with two rows of contact pairs.

The coil is designed as long as possible, so that the height of the relay may be as small as possible. It has been found that a coil with the dimensions specified above has a relatively low power consumption of approx. 0.5 to 0.8 Watts (0.75 Watts with the embodiment example), with a maximal current conduction of the contacts of 6 to 10 Amps (with the embodiment example 8 A). One may actuate six contact springs (four make-contacts and two break-contacts) with this power. With the smaller relays, the reduced dimensions are likewise sufficient for a correspondingly reduced number of contact pairs, wherein the power consumption may only be slightly reduced.

So that the drive has the suitable characteristics, the core is manufactured of a high-grade material with a small coercive field strength of roughly 40 A/M. The winding space is maximally utilised. The housing and a core cladding consist of a liquid crystal polymer and have a wall thickness of maximal 0.7 mm, at least in the region of the drive. In particular, walls in the inside of the housing which are relevant to the dimensions of the relay, have a wall thickness of maximal 0.5 mm. The relay base is 0.7 mm thick in the region of the contacts. The core cladding has a wall thickness of 0.4 mm.

The width of the six-contact relay, or the length of the three-contact relay, measure preferably at the most 35 mm, particularly preferably at the most 34 mm. This just about permits the feet of the contact springs, or the pins of the contact springs formed at the feet, to be arranged at a minimal raster distance to one another in the direction of the width of the housing. This distance in each case measures between 7.3 and 7.7 mm, preferably between 7.4 and 7.6 mm, and 7.5 mm in the embodiment example. This distance ensures that the prescribed 5.5 mm distance between the connection locations in the printed circuit board in which the pins are soldered or inserted, may be adhered to. The four-contact relay is longer than the three-contact relay by such a raster distance.

Advantageously, the pins for the contact pairs are arranged in a rectangular raster. The pins at the feet of the contact pairings are arranged on the housing edge. With the six-contact relay, the pins of the fixed counter-contacts are arranged symmetrically to a middle axis running in the direction of the width of the housing. In the direction of the length of the housing, the latter have a raster distance of at least 12 and at the most 18 mm to one another. Preferably, the distance between the pins of the fixed counter-contacts is equally large as the distance between the pins of the counter-contact and the contacts springs of a contact, and this is also achieved.

With a single-row relay, the pins of the fixed counter-contacts are arranged at the same distance to the pins of the contact spring as with the two-row relay. They therefore lie about 10 mm or about 19 mm from the edge of the housing.

Usefully, the contact pair lying closest to the drive pair or both contact pairs lying closest to the drive are break-contacts. They open away from the drive. The other two to four contact pairs are make-contacts and close away from the drive. The fixed counter-contact of the break-contact may be aligned slightly rotated with respect to an alignment orthogonal to the housing, so that the contact head of the loaded contact spring, which cooperates with it, rests on in an almost parallel manner. Amongst others, this arrangement has the advantage that thanks to the arrangement of this rotated-away, fixed counter-contact adjacent to the drive, this rotating-away of the fixed counter-contact leads to the fact that the distance between the drive and the first contact pair may be reduced, since the space required by the drive arm of the clapper-type contactor, and the separating wall between this space and the break-contact, run roughly in the same inclination as the counter-contact of the break-contact. The closer the fixed counter-contact approaches towards the foot of the contact spring, the larger does this reduction become. The separating wall may run in the desired direction from its end at the drive cam side, to beyond the contact head of the counter-contact. This serves for shortening the dimension of the housing directed perpendicular to the direction of the core (width with the two-row, length with a single-row relay).

In order for the distances of the pins to be minimal, the contact springs of the two make-contact pairs situated closest to the drive, and the contact springs of the make-contact pairs adjacent to these, converge from their foot to their head. The sparking distances and creepage distances between adjacent contact pairs may be extended to the necessary lengths in the inside, by way of separating walls on the base part and cover part, and by way of further obstacles on the drive cam.

With the two-row relay, the contacts springs situated closest the drive are usefully arranged in a symmetrical manner. That contact spring which is arranged on the side of the contactor, runs at least approximately parallel to the drive arm of the clapper-type contactor, or even diverging from the foot to the contact head end. This serves the shortening of the width of the housing. This is at least the case when a separating wall between the clapper-type contactor and the contacts is directed approximately parallel to the maximally folded-out drive arm of the clapper-type contactor. The drive arm is folded out maximally when the clapper-type contactor is attracted by the magnet.

Generally, with such a relay, at least one of the extended contact springs is not aligned orthogonally to the housing. The deviation of an alignment of the relaxed contact spring orthogonally to the housing outer surfaces having the housing height is predefined by an alignment of a foot receiver for the foot of the contact spring, which is formed on the housing. The adjustment of the foot receiver, which is the adjustment of the direction of the slot in a block formed in the housing, in combination with the unbent, extended contact spring, permits a very inexpensive general adjustment of the contact pairs on the housing, and specifically before the assembly of the relay. The adjustment is effected on the casting mould of the housing.

In order to be able to optimise the drive force of the relay, the pressing force of the make-contacts and the length of the overtravel, the contact spring in the region of the free drive end has a smaller cross section than between the foot and the contact head, and this tapered drive end projecting beyond the contact head has a length of 4 to 7 mm. This length and the tapered cross section permit a springing of this drive end beyond a contact point. The drive end preferably has a length of 5 to 6 mm. An overtravel which this permits is for example 0.3 to 0.7 mm.

The invention thus rises beyond the perception that each contact spring of each relay needs to be adjusted after the assembly and suggests a solution, which permits such an adjustment after the assembly to be able to be done away with. It thus permits the tolerance regions of the contact springs, of the distances between the contact head, of the biases of the contact springs, of the overtravels, of the force equilibriums between the drive and the contact spring assembly etc., to be reduced, and thus permits the size of the relay to be minimised.

Such a relay in the known manner has a housing and at least one adjusted contact pair therein. The contact pair advantageously comprises at least one contact spring, which for anchoring in the housing is inserted with a foot in a slot, which is formed in a block in the housing. The contact spring is equipped with a contact head, which cooperates with a contact head of the counter-contact.

The relay is advantageously characterised in that the contact spring of an adjusted contact pair is formed extended in the relaxed condition. A contact spring which is formed extended in this document is to be understood in that a straight line from a contact head end up to a foot end of the contact spring may be arranged within the contact spring. Usefully, contact springs are plane-surfaced parts, without any form of bending or curvature, with the exception of the doubling of the thickness of the foot by way of a folding of the spring material at the foot end. A further exception may be a hook formation at the drive end of the contact spring, which is to prevent a broken contact spring from falling out of the drive cam. Such contact springs which are formed extended from their anchoring, up to the contact head or even beyond the contact head, may be manufactured with very low tolerances.

The relay is further advantageously characterised in that the direction of the slots is predefined in a manner such that in an idle condition of the relay, the contact head of the contact spring is arranged within a selected distance range to the contact head of the counter-contact, when the contact spring is part of a make-contact. The relay may comprise make-contacts or break-contacts and preferably has both. For this reason, with the relay alternatively or additionally with a break-contact, the direction of the slot is defined in a manner such that a pressing pressure of the contact head of the loaded contact spring, with which this contact head is pressed against the contact head of the counter-contact in the idle condition of the relay, lies within a selected pressure range. Thereby, what is essential with regard to the invention is that the adjustment of the contact springs is not effected by kneeing or bending, but the contact spring of an adjusted contact pair is extended in the relaxed condition, however the direction of the slot in which its foot is anchored, is adjusted. Such an adjustment may be carried out on the housing or on the cast mould of the housing. Since the injection moulded parts and the extended contact springs may be manufactured with very tight tolerances, an adjustment of the contact springs after the assembly of the relay is no longer necessary. For the manufacture of such a relay therefore, the direction of the slots is to be adjusted with the injection mould, before the relay goes into production. In exchange, the work of a later adjustment of the individual contact springs is largely done away with. Despite this however, it may make sense and be necessary to control the adjustment, and individual contact springs nevertheless may be adjusted afterwards, as the case may be. If it is also desired for none of the contact spring to have to be adjusted at a later stage, then a relay according to the invention merely comprises a single contact spring, which is adjusted according to the invention. Preferably all contact springs are adjusted in this manner.

The counter-contact is preferably a fixed contact and is not also a contact spring. A fixed counter-contact may be applied into the housing with very small tolerances. One however does not also rule out designing the counter-contact as a spring. Such a contact spring of a counter-contact is also designed extended in the relaxed condition. It is anchored in a slot in a block formed in the housing. In contrast to the first contact spring it presses against an abutment formed on the housing. The slot is aligned with respect to the abutment, in a manner such that the pressing force of the contact spring against the abutment lies within a selected pressure range.

The users of relays desire the pins of the contact pairs to be arranged in an orthogonal raster. This not only has aesthetic aspects, but also simplifies the adherence to sparking and creepage distances on a printed circuit board.

In order for the orthogonal alignment of a pin arrangement and the adjustment of the contact pairs to be able to be simultaneously achieved by way of the adaptation of the direction of the slot, where appropriate, the slot must be aligned with regard to the housing differing from an orthogonal alignment.

Thereby, one accepts the fact that the planes of the pins are not directed orthogonally, but only the axes of the pins are arranged in an orthogonal raster. The planes of the pins are usefully parallel to the plane of the extended contact spring. This is because the pin of the contact spring is advantageously designed as one piece with the contact spring. The single-piece design of the contact spring, and the pin of a piece of highly conductive spring material reduces the effort on assembly of the relay, reduces the tolerances with the contact spring, and ensures a first-class conductivity at the transition from the pin to the contact spring. The pin is usefully formed on the foot of the contact spring.

This deviation from the orthogonal alignment, as the case may be, may be a sign that the contact springs have been adjusted by the adaptation of the direction of the slot. This slot direction differing from the orthogonal alignment, may therefore considered as an independent invention, independently of whether the contacts springs have been adjusted after their installation by way of bending or not.

A transition between a contact region of the contact spring and the foot of the contact spring is advantageously designed extended, in order to avoid the deviations between the individual contacts springs occurring on bending.

With a method for adjusting the alignment of a contacts spring of a contact pair, which is anchored with a foot in a slot in a housing of a relay, one is to succeed in a distance between the contact heads of the contact pair lying within a selected distance range or a pressing force between the contact heads of the contact pair lying within a selected pressure range. With such a method, according to the invention, the direction of the slot is adjusted in an exact manner, and a contact spring designed in an extended manner is inserted into the adjusted slot. The block in which the slot is formed may be designed rotatable relative to the housing, for adjusting the slot. In this case, the adjustment of the direction of the slot includes a rotation of the block and the fixation of the block with respect to the housing in the adjusted direction. In order however for this adjustment to only have to be carried out once, it is preferable for the injection mould which defines the direction of the slot, to be adapted. Part moulds may be provided with the injection mould, which comprise the slots or the blocks with slots. Thus only these part moulds need to be adapted. Should a later delivery of contact springs for example have different parameters than an earlier delivery, then these part moulds are replaced by those which are adjusted for the new delivery of contact springs.

The slots thereby mostly fall out of an orthogonal alignment with respect to the housing and/or an orthogonal pin raster. Despite this, it may occur that a slot, despite this, is orthogonal to the housing, or the pin raster. The slot therefore as a rule, is aligned at an angle to the housing which differs by 0, 90, 180 and 270 degrees.

In order for the adjustment of the contact pairs to be able to be carried out by way of the direction of the slots, advantageously the precision of the contact springs must be checked before the insertion into the slot. With this, one checks whether the adjustment to the contact pins to be inserted is correct, or whether they need to be adapted.

In order for the contacts pins at least of one delivery to be identical within very tight tolerances, the foot at the contact pin is advantageously formed by folding the spring material. Folding, which is to say bending by 180 degrees, may be carried out with a very constant result, whereas a bending by a lesser angle, be it obtuse or oblique, leads to larger scatters. With folding, the extended formation of the contact springs remains untouched. A transition between the foot and a spring region of the contact spring should be designed in an extended manner, so that the contact spring may be manufactured with a high precision.

Figure 1:
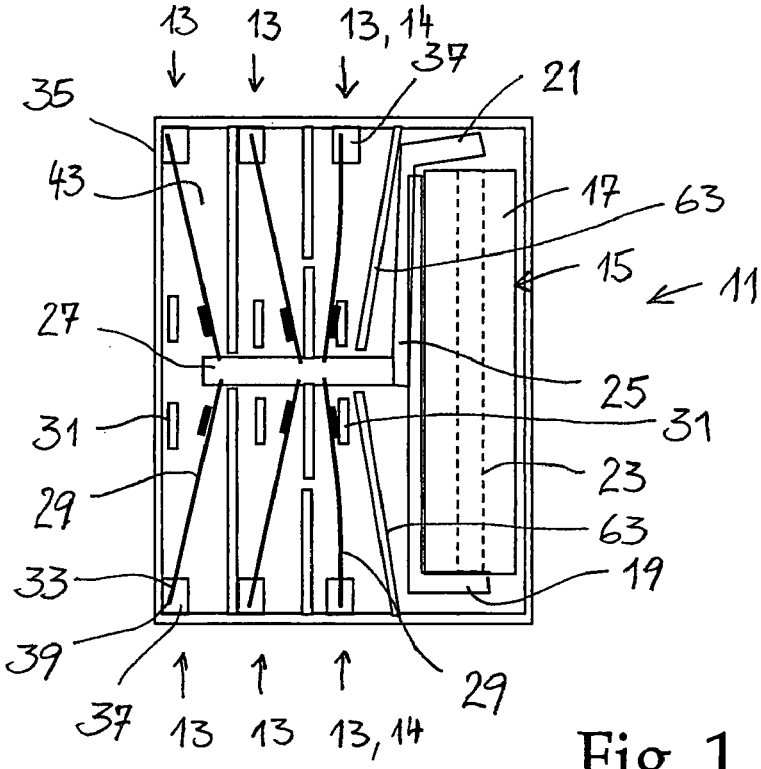
FIG. 1 schematically shows a plan view of an opened relay with three contact pairs lying opposite one another, and with a drive arranged in the longitudinal direction of the housing.
Figure 2:
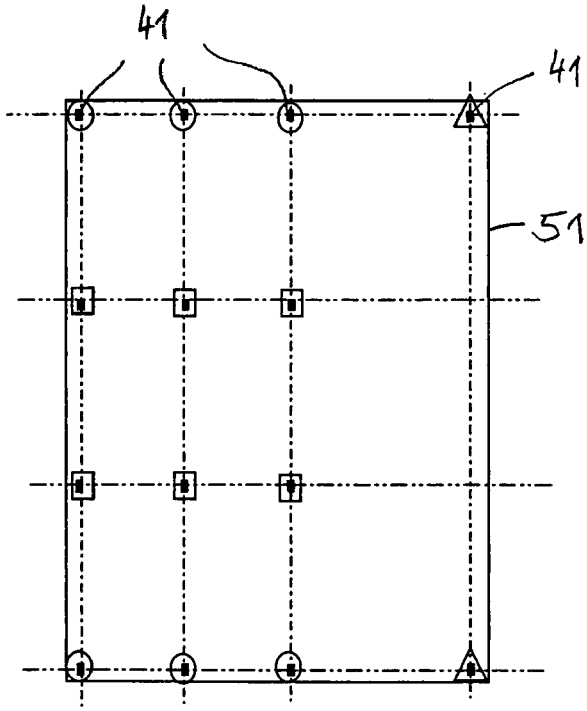
FIG. 2 schematically shows the orthogonal pin arrangement of the relay according to FIG. 1.
Figure 3:
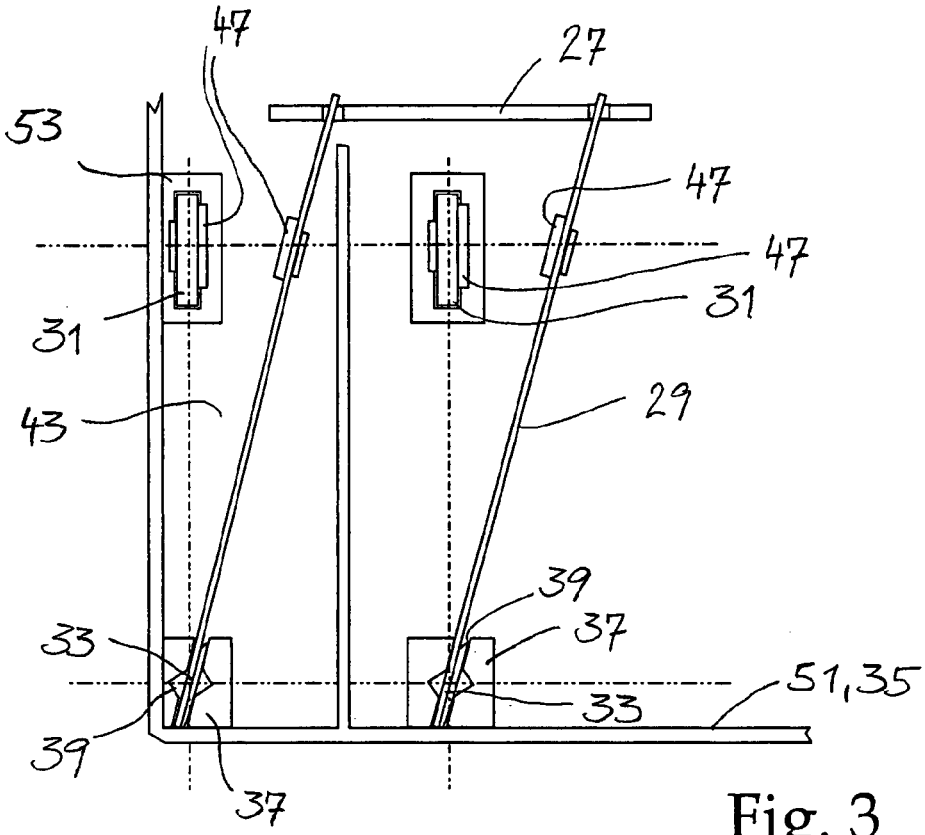
FIG. 3 schematically shows two make-contacts and a break-contact in the idle position.
Figure 4:
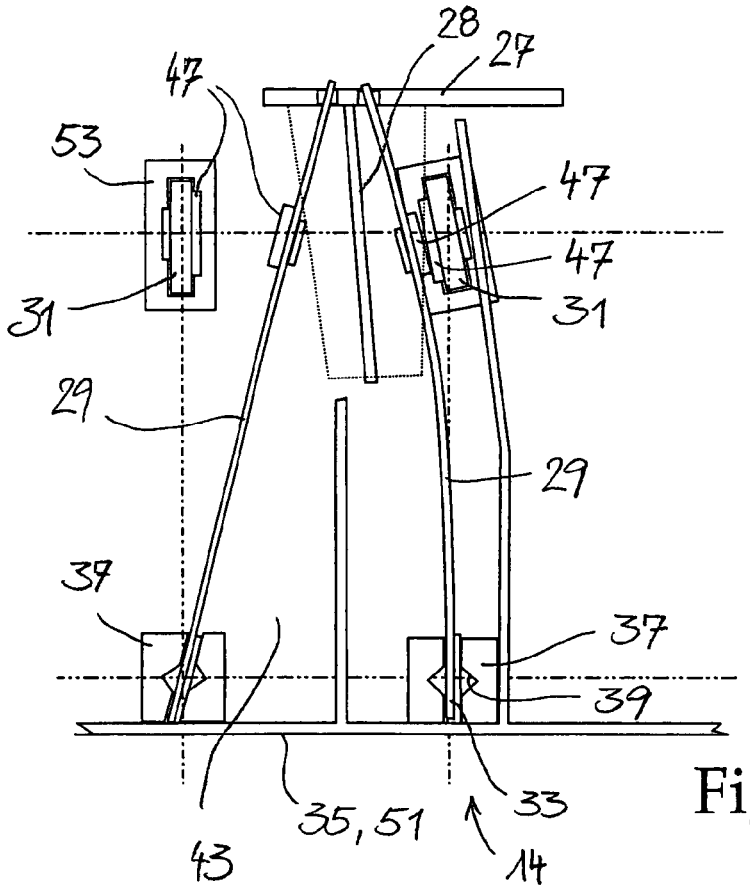
FIG. 4 shows a make-contact and a break-contact in the idle position.

The relay 11 represented in FIGS. 1, 2 has six contact pairs 13. The number of contact pairs 13 in a relay 11 is not significant to the adjustment of a contact pair 13, but is decisive for the size and application ability of the relay.

The relay 11 furthermore has an electromagnetic drive 15 with a coil 17, a yoke 19, a clapper-type contactor 21 and a core 23 represent dashed. It further comprises a drive cam 27 cooperating with the drive arm 25 of the clapper-type contactor 21.

The coils 17 are wound in an as space-filling as possible manner. Depending on the desired coil voltage, the winding number and the wire diameter, and thus the coil resistance may be adapted. Thereby however, the AW-number (Ampere*windings), which corresponds to the coil force, remains practically the same. The AW-number with the present embodiment is at least 310 AW. Depending on the wire thickness, the AW-number may exceed this 310 AW, since the coil is filled. An adequate force of the coil to actuate the six contact pairs 13 results with a coil ratio of 4.6-5 to 1, in particular 4.7-4.8 to 1, and with an contactor transmission ratio of 1 to 3.5-3.7, in particular of 1 to 3.6. The subsequent list shows a small selection of possible coil designs:

| coil voltage V | winding number N | wire diameter mm | coil resistance Ohm | wire resistance Ohm/m | wire length m |
|---|---|---|---|---|---|
| 5 | 2360 | 0.16 | 43.2 | 0.8502 | 50.8 |
| 15 | 6250 | 0.1 | 300 | 2.177 | 137.8 |
| 24 | 11300 | 0.075 | 1000 | 3.869 | 258.5 |
| 110 | 52000 | 0.036 | 20900 | 16.79 | 1244.8 |

Each contact pair 13 comprises a contact spring 29 and a counter-contact 31. The contact springs 29 are anchored in a housing 35 with a foot 33, in which housing 35 the drive 15 is also accommodated. For anchoring the foot 33, a block 37 is formed in the housing 35 for each foot, and in each case a slot 39 in the block 37.

Figure 6:
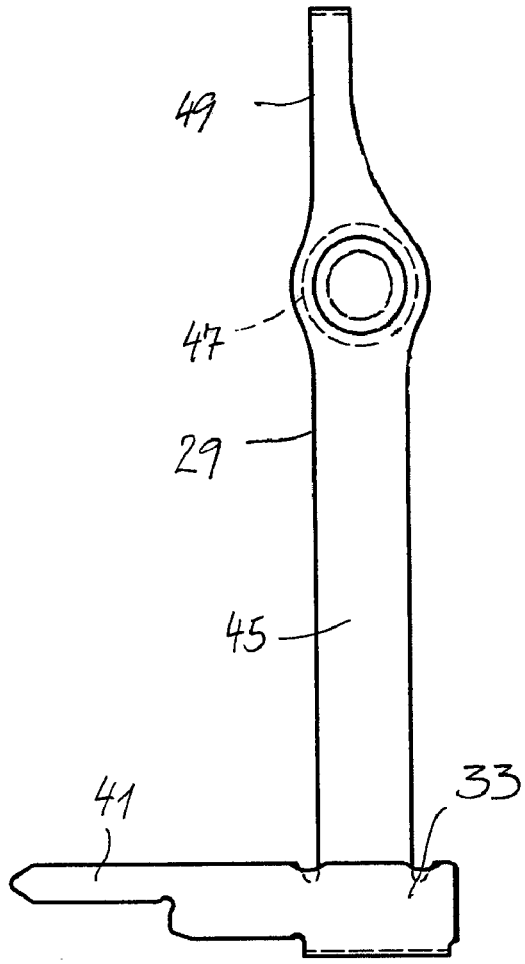
FIG. 6 shows a lateral view of the contact spring according to FIG. 5.
Figure 7:
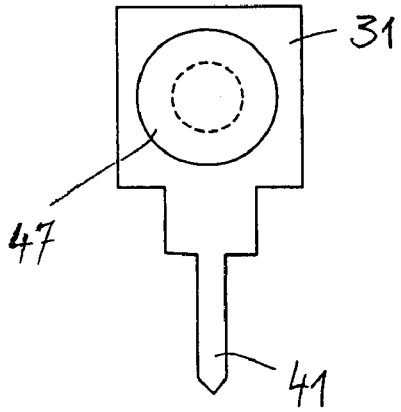
FIG. 7 shows a fixed contact head.

The counter-contacts 31 and the contact springs 29 are in each case equipped with a pin 41 (see FIGS. 6 and 7). With these pins 41, the contact springs 29 as well as the counter-contacts 31 penetrate through the base 43 of the housing 35. The orthogonal arrangement of the pins 41 is represented with the lower view of the relay 11 represented in FIG. 2. The pins 41 characterised with an ellipse are the foot pins of the contact springs 29. The pins characterised with a rectangle are the pins of the fixed counter-contacts. The pins characterised with a triangle are the connection pins of the drive. The foot pins of the contact springs 29, and the connection springs of the drive 15 are rowed along the two narrow sides of the base 43 lying opposite one another. The six pins of the counter-contacts are in each case three on a parallel line to the narrow sides of the base, and in each case two on a straight line through two foot pins of the contact spring which lie opposite one another.

The raster distances between the pins of the contact pairs 13 are in each case 7.5 mm in the direction of the width of the housing, and in each case 15.8 mm in the direction of the length of the housing 35. The connection pins of the drive are in the two corners of the housing base 43 which are not equipped with the foot pins of the contact springs, and at a distance of 15.5 mm to the next pin of the contact pairs 13.

Figure 5:
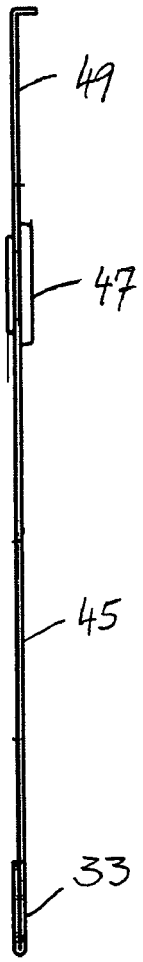
FIG. 5 shows a view of a contact spring with an integrated foot and pin.

The contact springs 29, as represented in FIGS. 5 and 6, have a foot 33 which is formed by a folding up of the sheet-metal part of the contact springs. The pin 41 is designed as one piece with the foot 33 and is therefore likewise double the thickness of the contact spring. The contact spring 29 connecting to the foot 33, has a spring region 45 which extends up to the contact head 47. The spring region 45 has a minimalised cross section of a highly conductive spring material. The cross section and the material are optimised with respect to thermal conductivity and electrical conductivity. The contact spring is somewhat widened in the region of the contact head 47. The contact spring above the contact head has a drive end 49 in the form of an extension with a tapering cross section. The drive end 49 has almost half the cross section of the spring region 45. The drive end 49 is furthermore bent into a hook, so that the contact springs 29 may not fall out of the drive cam 27 with a breakage of the spring.

The counter-contacts 31 are stationary contact parts which are fastened in the housing in an exactly defined position. The counter-contacts 31 are parts punched from relatively thick sheet-metal, on which a pin 41 is formed as one piece (FIG. 7), and which are equipped with a contact head 47. With all contacts, the contact heads are rivet heads with all contacts. For fastening the contact heads, in each case a hole is punched out in each contact spring and in the sheet-metal part of the counter-contact 31, through which the rivet head is inserted. The inserted-through end is then hammered, in order to rivet the contact head with a positive and non-positive fit.

Figure 8:
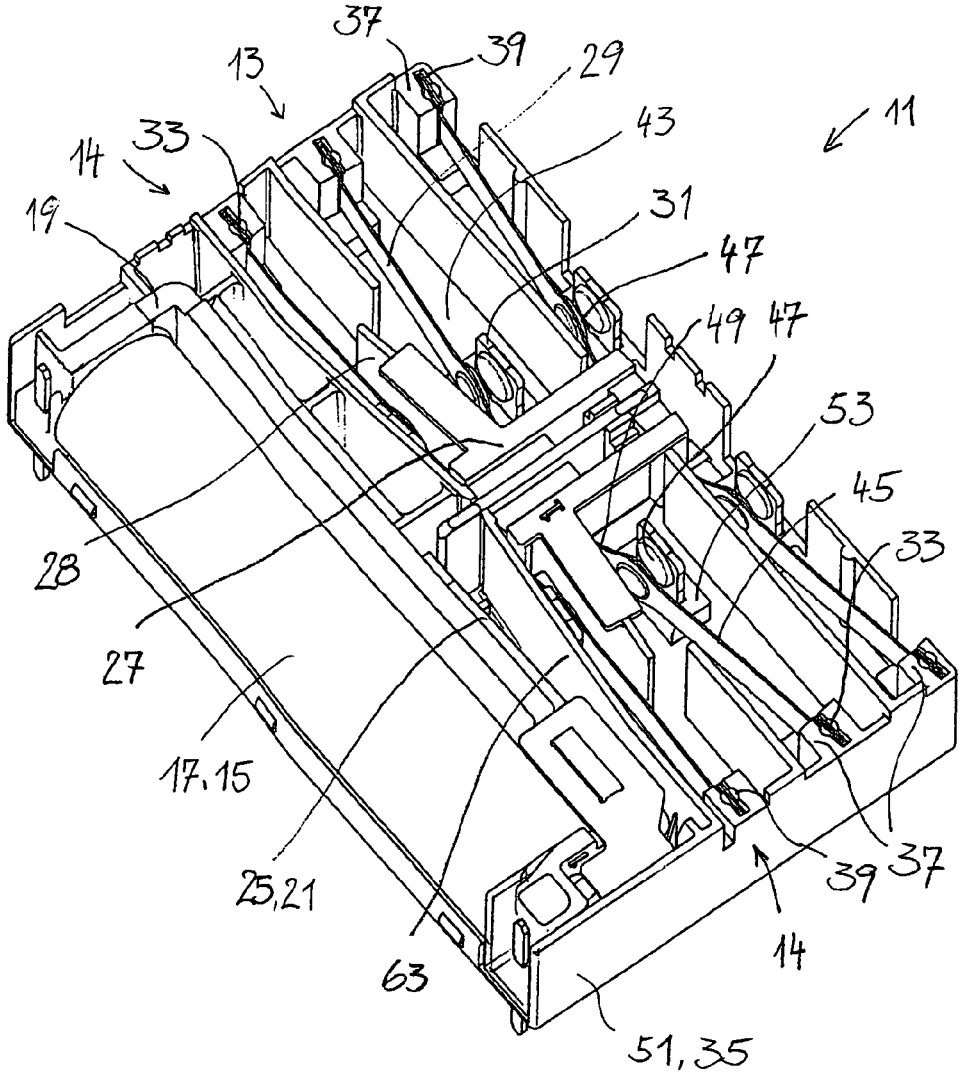
FIG. 8 shows a perspective representation of a relay according to the invention with a removed cover.

The relay represented in FIG. 8 is represented without a cover. Therefore, a cover is inserted over this relay, which concludes the assembly, and the cover is locked with the base part in which the drive and the contact pairs are arranged, and terminates the housing. The relay description and the relay specifications may be written on the cover.

The following parts are therefore represented in FIG. 8:

the base part 51 with a base 43 and a division into chambers for the contact parts and the drive, which is formed by walls 63 as well as with blocks 37, 53 for the anchoring of the contacts 29, 31 of the contact pairs 13;

the drive 15 applied into the base part 51, of which the coil 17, the yoke 19 and the clapper-type contactor 21 may be recognised;

four break-contact pairs 13 each with a relaxed, extended contact spring 29 and a fixed counter-contact 31;

two break-contact pairs 13 each with a loaded contact spring 29 and a fixed counter-contact 31;

a drive cam 27 which is in abutment with the drive arm 25 of the clapper-type contactor 25, and in which the drive ends of the contact springs 29 are accommodated. An individual chamber is formed for each contact spring in the drive cam.

The drive cam 27 is furthermore provided with wings 28. The wings 28 extend the creepage and above all the sparking distances between the adjacent contact pairs 13.

Figure 9:
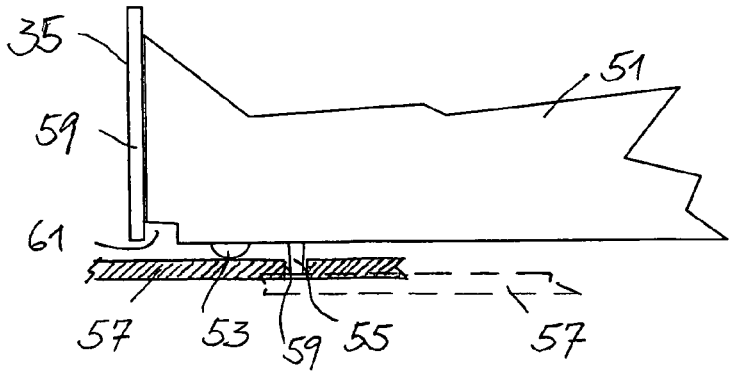
FIG. 9 shows a section of a relay with feet and stilts on a printed circuit board.

The relay 11 according to FIG. 8, without the cover, measures 52.4×32.3×9.9 mm. Added to the height, as shown in FIG. 9, are the spacer feet 32 and the cover. Spacer feet 53 are formed on the lower side of the base part 51 and project by 0.5 mm. The relay additionally has stilts 55. The stilts 55 are slightly conical truncated cones or circularly cylindrical pegs on the lower side of the base part 51, which project by 1.2 mm. This formation of spacer feet 53 as well as stilts 55 has the advantage that the relay may be arranged at two different distances to a circuit board 57. If SMD-components are yet to be able to be arranged below the relay base, one then sets the relay on stilts 55 (circuit board 57 drawn with interrupted lines). If thereby, the construction height is to be as small as possible, then the relay 11 may also be set on the spacer feet 53 (circuit board 57 represented with unbroken lines). The stilts may be broken away so that the relay may be set on the spacer feet. Thereby, it would be much simpler to provide bores 59 for the stilts 55 in the circuit board 57, additionally to the bores for the pin connections.

The cover 59 indicated in FIG. 9 completely peripherally encloses the base part 51 of the relay 11. A casting channel 61 is formed between the cover 59 and the base part 51 for sealing the relay 11 with a casting mass.

Figure 10:
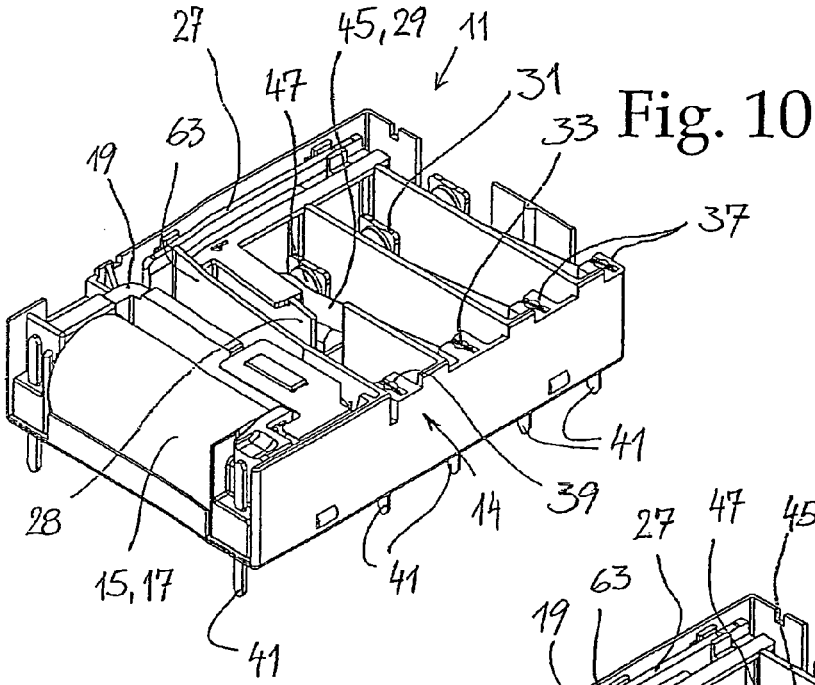
FIG. 10 shows a relay according to the invention, with four contact pairs.
Figure 11:
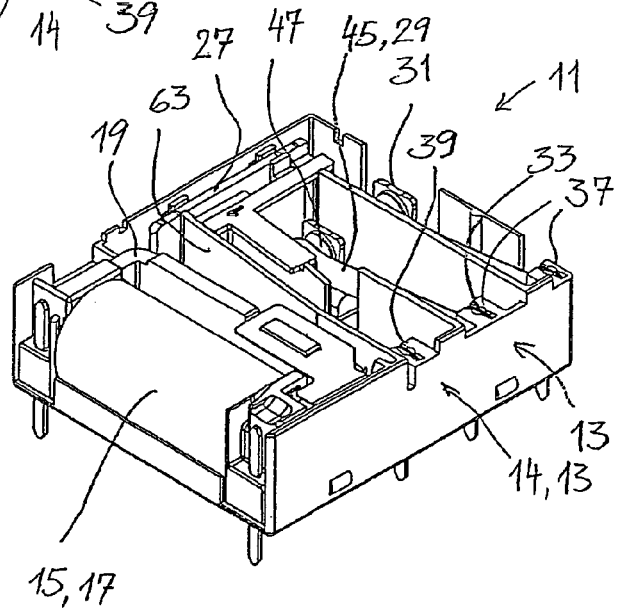
FIG. 11 shows a relay according to the invention, with three contact pairs.

The relay according to the invention, as in FIGS. 1, 2 and 8, may comprise two rows of contact pairs, which are formed symmetrically to one another, but also however only a single row of contact pairs. Such a four-contact and three-contact relay is shown perspectively in the FIGS. 10 and 11. With these, the length of the coil, and of the housing in the direction of the length of the coil are practically halved compared to the relay according to FIG. 8. The length of the relay according to FIG. 10 is furthermore extended by one contact pair. By way of this, the length of the four-contact relay is 7.5 mm longer than the width of the six-contact relay.

The dimensions of the relay are as follows:

| contacts | height (without pins and spacer feet) | dimension parallel to core (with cover) | dimension perpendicular to core (with cover) |
|---|---|---|---|
| 1 break-contact, 2 make-contacts | 10.5 mm | 29.5 mm (width) | 33.6 mm |
| 1 break-contact, 3 make-contacts | 10.5 mm | 29.5 mm (width) | 41.1 mm |
| 2 break-contacts, 4 make-contacts | 10.5 mm | 53.8 mm (length) | 33.6 mm |
| 2 break-contacts, 6 make-contacts (not shown) | 10.5 mm | 53.8 mm (length) | 41.1 mm |

The dimension perpendicular to the core of the coil is composed of 7.5 mm between in each case two contact pairs of a row, and 18.5 mm for the drive, the housing and the distance between the drive and the break-contact. 16.9 mm is required from the one outer side of the relay which runs along the drive, up to the first pin (of the break-contact). 1.6 mm is yet required from the last pin to the opposite outer side.

In the other direction, the pins of one contact pair have a distance of 15.8 mm, the pin of the contact spring up to the close edge of the relay 3.1 mm. The pin of the fixed contact has a distance to the opposite edge of 10.5 mm. With a two-row relay, the pins of the fixed contacts of the two rows have a distance of 15.8 mm to one another.

These dimensions include the cover, which on the five sides which it covers, is in each case 0.6 mm.

With the single-row relay, the coil data may be specified for example as follows. Further designs of the coils are of course possible. The coil is 18.5 mm long, has a diameter of 9 mm and with four contact pairs, one strives for an AW-number of 200 or more.

Relay with four contact pairs

| coil voltage V | winding number N | wire diameter mm | coil resistance Ohm | wire resistance Ohm/m | wire length m |
|---|---|---|---|---|---|
| 12 | 3700 | 0.085 | 240 | 3.012 | 79.7 |
| 15 | 4050 | 0.08 | 300 | 3.401 | 88.2 |
| 24 | 7400 | 0.06 | 960 | 6.286 | 152.7 |

LIST OF REFERENCE NUMERALS

11 relay
13 contact pair
14 break-contact pair
15 drive
17 coil
19 yoke
21 clapper-type contactor
23 core
25 drive arm of the clapper-type contactor 21
27 drive cam
28 wings of the drive cam 27
29 contact spring
31 fixed counter-contact
33 foot of the contact spring 29
35 housing
37 block
39 slot in the block 37 for the foot
41 contact pin
43 base of the housing 35
45 spring part of the contact spring 29
47 contact head 29
49 drive end of the contact spring 29
51 base part of the housing 35
53 stand feet
55 stilts
57 printed circuit board
59 cover part of the housing 35
61 casting channel
63 wall forming a division of the base part 51 into chambers for the contact parts and the drive

The invention claimed is:

1. A forcibly guided relay, with a housing, whose height is smaller than its width, and whose width is smaller than its length, comprising:

an electromagnetic drive filling the length or width of the relay, which comprises a coil with an elongate core of a magnetic soft iron, and a winding present around the core, and a clapper-type contactor;

said winding having a diameter practically filling the height of the housing, and said clapper-type contactor comprising a drive arm which extends in the direction of the core and which at its free end movably cooperates with a drive cam, wherein the direction of the core is defined by the direction of the length of the core, the length of the core being greater than the width and height of the core;

several contact pairs, which in each case are formed by a contact spring and a fixed or spring-like counter-contact, said contact springs:

comprising a foot and a free drive end, as well as a contact head between the foot and the drive end, being anchored in the housing, in each case with the foot at locations along a side of the housing, the side being approximately perpendicular to the direction of the core, said locations being distanced to one another;

extending in a direction approximately parallel to the direction of the core, and arranged such that the drive ends are in forcibly guided engagement with the drive cam; and contact pins for the contact pairs and for the drive, said contact pins projecting out of the housing approximately perpendicular to a surface of the housing defined by the width and length, wherein a break-contact is arranged directly next to the contactor, whose contact spring is arranged at least approximately parallel to the drive arm of the clapper-type contactor in each position of the contactor; and a separating wall between the clapper-type contactor and the break-contact, at least in the region between the contact heads of the break-contact, and the drive cam, is arranged approximately parallel to the drive arm of the clapper-type contactor in its position most remote from the coil.

2. A relay according to claim 1, wherein the pins are positioned in a raster orthogonal to the length and width of the relay, the pins of the contact springs are arranged at a small distance to an edge of the relay, and the pins of the counter-contacts at a larger distance to the edge of the relay, wherein the pins of adjacent contact pairs in each case have an equal distance of 7.3 to 7.7 mm, perpendicular to the direction of the core.

3. A relay according to claim 1, wherein the counter-contact of the break-contact bordering the drive, is rotated deviating from an alignment orthogonal to the housing, approximately parallel to the drive arm of the clapper-type contactor in its position which is most remote from the coil.

4. A relay according to claim 1, wherein the dimension perpendicular to the direction of the core between the outer side of the relay running along the coil, and the pin of the contact spring of the break-contact bordering the drive, which is required for the drive, measures maximally 17.8 mm.

5. A relay according to claim 1, wherein its height is maximally 12 mm, and with which the diameter of the coil measures 8 to 10 mm.

6. A relay according to claim 1, wherein a wing extending the sparking and creepage paths is formed on the drive cam between the contact spring of the break-contact and the contact spring of a make-contact adjacent to the break-contact.

7. A relay according to claim 1, wherein the housing and a core casing consist of a liquid crystal polymer, and the housing at least in the region of the drive has wall thicknesses of maximally 0.7 mm.

8. A relay according to claim 1, wherein the contact spring of the break-contact and the contact spring of a make-contact pair adjacent to the break-contact, run in a convergent manner from their foot to their head.

9. A relay according to claim 1, wherein the contact springs in the region of the free drive ends have a smaller cross section than between the foot and the contact head, and the drive ends projecting beyond the contact head have a length of 4 to 7 mm, in order to ensure an overtravel.

10. A relay according to claim 1, wherein a deviation of the direction of the contact springs in a relaxed state from an alignment orthogonal to the housing is predefined by an alignment to a slot formed on the housing in a block, for receiving the foot of the contact spring.

11. A relay according to claim 1, wherein the contact pairs are arranged in a first row and a second row, the drive ends of the contact springs of contact pairs of the first row are directed opposite to the drive ends of the contact springs of the second row, the drive ends of the first and second rows are engaged into the drive cam as a common drive cam, the coil fills the length of the housing, and the drive arm of the clapper-type contactor is approximately half as long as the length of the coil, and with its end actuates the drive cam.

12. A relay according to claim 11, wherein each row comprises a break-contact and two further contact pairs, wherein the length of the relay measures maximally 56 mm, and the length of the coil measures at least 40 and at the most 46 mm.

13. A relay according to claim 11, wherein the width of the relay measures 35 mm at the most, and the feet of the contact springs as well as the pins, in the direction of the width of the housing, have a minimal raster distance to one another, which measures in each case between 7.3 and 7.7 mm.

14. A relay according to claim 11, wherein the pins for the contact pairs are arranged in a rectangular raster, the pins at the feet of the contact pins are arranged on the housing edge, and the pins for the fixed counter-contacts are arranged symmetrically to a middle axis running in the direction of the width of the housing, and in the direction of the length of the housing have a raster distance of at least 12 and at the most 18 mm to one another, have the same distances between the pins of the fixed counter-contacts of the two rows, as between the pins of the counter-contact and the contact spring of a contact pair of each row.

15. A relay according to claim 11, wherein the coil has an AW-number between 260 and 340, and has a power consumption of 0.45 to 0.85 Watts.

16. A relay according to claim 1, with a housing which on a housing lower side comprises spacer feet for distancing the relay to a circuit board, with stilts on the housing lower side which project more than the spacer feet.

17. A relay according to claim 16, wherein the stilts project 1 to 1.5 mm and project beyond the spacer feet by 0.5 to 1 mm.

18. A relay according to claim 2, wherein the counter-contact of the break-contact bordering the drive, is rotated deviating from an alignment orthogonal to the housing, approximately parallel to the drive arm of the clapper-type contactor in its position which is most remote from the coil.

19. A relay according to claim 3, wherein the dimension perpendicular to the direction of the core between the outer side of the relay running along the coil, and the pin of the contact spring of the break-contact bordering the drive, which is required for the drive, measures maximally between 17.0 and 17.8 mm.

20. A guided relay with a housing of a height smaller than its width, the width being smaller than its length, comprising:

an electromagnetic drive filling the length or width of the relay, which comprises a coil with an elongate magnetic soft iron core, a winding being present around the core, and a clapper-type contactor comprising a drive arm which extends in the direction of the core and which at its free end movably cooperates with a drive cam, wherein the direction of the core is defined by the direction of the length of the core, the length of the core being greater than the width and height of the core;

several contact pairs, which in each case are formed by a contact spring and a fixed or spring-like counter-contact, said contact springs comprising a foot and a free drive end, the drive ends being in engagement with the drive cam; and contact pins, said contact pins projecting out of the housing approximately perpendicular to a surface of the housing defined by the width and length, wherein a break-contact is arranged directly next to the contactor, whose contact spring is arranged at least approximately parallel to the drive arm of the clapper-type contactor in each position of the contactor; and a separating wall between the clapper-type contactor and the break-contact is arranged approximately parallel to the drive arm of the clapper-type contactor;

the contact pairs are arranged in a first row and a second row, the drive ends of the contact springs of contact pairs of the first row are directed opposite to the drive ends of the contact springs of the second row; and the drive ends of the first and second rows are engaged into the drive cam as a common drive cam.

21. A relay according to claim 1, wherein the contact pairs are arranged in a first row and a second row, the drive ends of the contact springs of contact pairs of the first row are directed opposite to the drive ends of the contact springs of the second row, and the drive ends of the first and second rows are engaged into the drive cam as a common drive cam.

* * * * *